US006642450B1

(12) United States Patent
Hsiao

(10) Patent No.: US 6,642,450 B1
(45) Date of Patent: Nov. 4, 2003

(54) WALL OUTLET ASSEMBLY

(76) Inventor: Feng-Shen Hsiao, 10th Fl., No. 5, Sec. 1, Tun Hua S. Rd., Taipei (TW)

( * ) Notice: Subject to any disclaimer, the term of this patent is extended or adjusted under 35 U.S.C. 154(b) by 0 days.

(21) Appl. No.: 10/313,749

(22) Filed: Dec. 6, 2002

(51) Int. Cl.[7] ..... H01R 13/46

(52) U.S. Cl. ..... 174/53; 174/48; 174/49; 439/540.1; 439/535; 439/538; 439/650; 439/502; 439/527; 439/652; D13/143

(58) Field of Search ..... 174/53, 48, 49; 439/540.1, 535, 538, 540, 502, 650, 651, 652, 527, 528; D13/143

(56) References Cited

U.S. PATENT DOCUMENTS 4,993,970 A * 2/1991 Littrell ..... 439/535
5,645,449 A * 7/1997 Sabo ..... 439/540.1
5,807,139 A * 9/1998 Volansky et al. ..... 439/638
5,924,892 A * 7/1999 Ferracina ..... 439/501

FOREIGN PATENT DOCUMENTS

CA 2136798 A * 5/1995 ..... 174/53

* cited by examiner

*Primary Examiner*—Dean A. Reichard
*Assistant Examiner*—Anton Harris
(74) *Attorney, Agent, or Firm*—William F. Pelton, Esq.

(57) ABSTRACT

A wall outlet assembly has a housing composed of a front casing and a rear casing, and two bases respectively and rotatably provided at opposite sides of the housing, wherein each base has multiple sockets formed thereon. Since the bases are rotatable, the base is able to be turned to a desired position to allow any plug to be easily inserted into the sockets on the bases.

19 Claims, 8 Drawing Sheets

WALL OUTLET ASSEMBLY

BACKGROUND OF THE INVENTION

1. Field of the Invention

The invention is related to a wall outlet assembly, and more particularly to a wall outlet assembly having two rotatable bases, on which sockets are defined, respectively and rotatably equipped at opposite sides of a housing of the wall outlet assembly. By properly turning the two bases to a desired position, plugs can be easily inserted into the sockets on the two bases.

2. Description of Related Arts

With reference to FIG. 8, a general conventional wall outlet is constructed by a housing (50) with a top plate and a bottom plate. On the top plate, multiple first pairs of first holes (51) and second holes (52) are defined, wherein each second hole (52) corresponds to a pair of first holes (51) to form a complete socket. At the bottom plate, at least one plug with a grounding blade (not shown) and two contact blades (not shown) is provided. Inside the housing (50), multiple conductive plates that electrically connect with the plug are arranged therein and respectively correspond to the sockets formed by the holes (51, 52).

After the plug is electrically inserted into an outlet that is generally located on the wall in the house, all sockets on the housing (50) are faced away from the wall. However, since most wires are usually laid out along the joint between the floor and the wall, users must slightly bend the wires to make the plugs of these wires can directly insert into the sockets.

To overcome the mentioned shortcomings, a wall outlet assembly in accordance with the present invention obviates or mitigates the aforementioned problems.

SUMMARY OF THE INVENTION

The objective of the present invention is to provide a wall outlet assembly with two rotatable bases on which sockets are formed, whereby plugs are able to be directly connected with the sockets by turning the bases at any desired angle without bending wires.

To accomplish the objective, the wall outlet has a housing with two opposite sides where two bases are respectively and rotatably equipped, wherein each base has at least one socket formed thereon for electrical connection with a plug.

The features and structure of the present invention will be more clearly understood when taken in conjunction with the accompanying figures.

DETAILED DESCRIPTION OF THE PREFERRED EMBODIMENT

Figure 1:
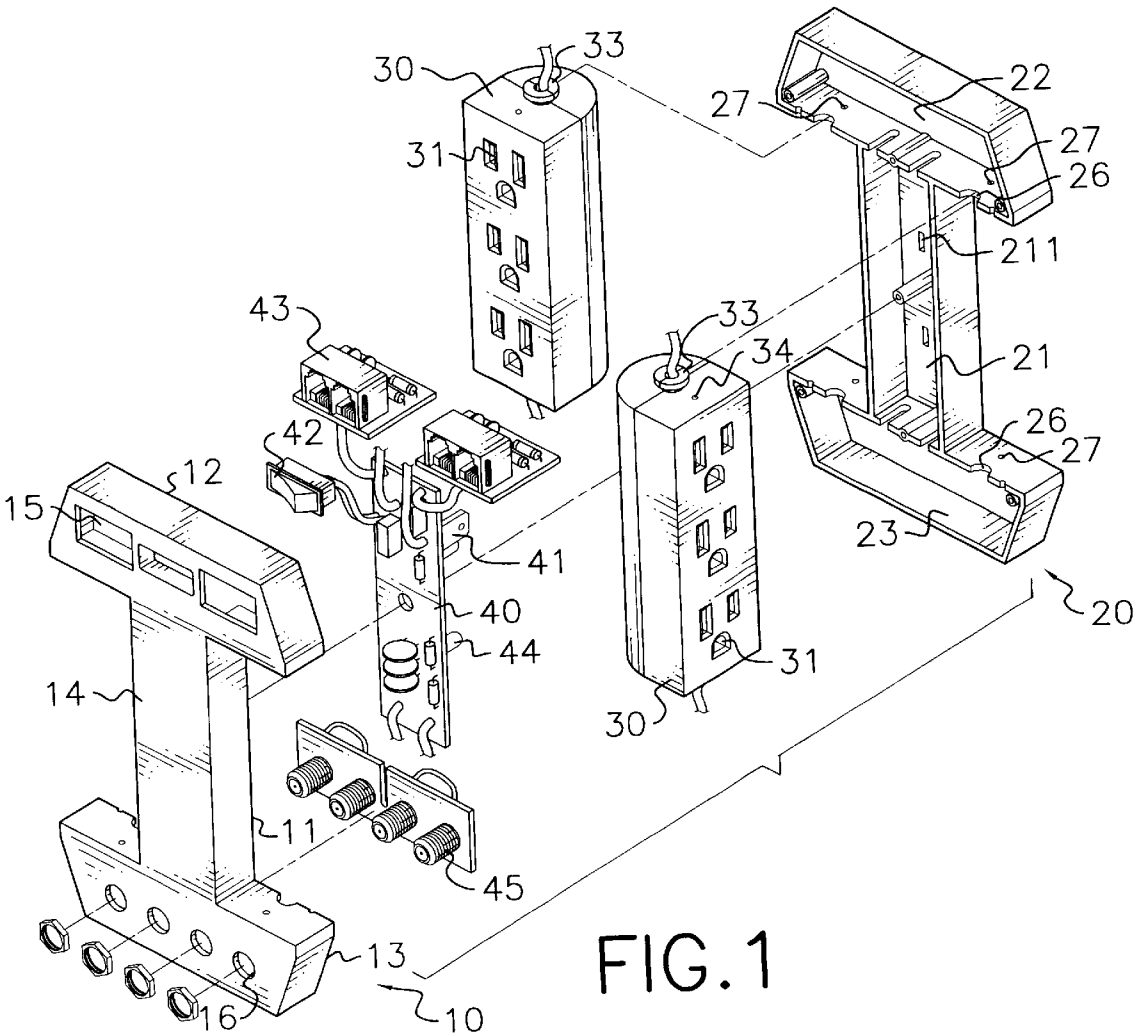
FIG. 1 is an exploded perspective view of the wall outlet assembly in accordance with the present invention.

With reference to FIG. 1, a wall outlet assembly in accordance with the present invention has a housing composed of a front casing (10) and a rear casing (20). The two casings (10)(20) are configured to be symmetrical each other. Each casing (10)(20) is formed by a rectangular center chamber (1 1)(21) with opposites sides that respectively communicate with a trapezoid upper chamber (12)(22) and a trapezoid lower chamber (13)(23). Therefore, each casing (10)(20) is formed to be a substantially I-shaped casing. After the two casings (10)(20) are correspondingly combined together, two lengthwise spaces are accordingly formed at opposites sides of the two rectangular center chambers (11)(21) and between the upper chambers (12)(22) and the lower chambers (13)(23).

Two bases (30), each of which has multiple sockets (31) formed thereon, are respectively placed in the two spaces and rotatably received between the upper chamber (12)(22) and the lower chamber (13)(23).

A circuit board (40) is to be installed inside the rectangular center chambers (11)(21) after the front casing (10) and the rear casing (20) are combined together. At least one plug (41) having a grounding blade and two contact blades, a switch (42) and multiple telephone wire connectors (43) are provided on the circuit board (40). The switch (42) is provided to control whether all the sockets (31) of the two bases (30) are able to conduct electricity. The two bases (30) are electrically connected to the circuit board (40), whereby each socket (31) is able to conduct electricity when the plug (41) is inserted into an outlet (not shown) in a wall.

Figure 2:
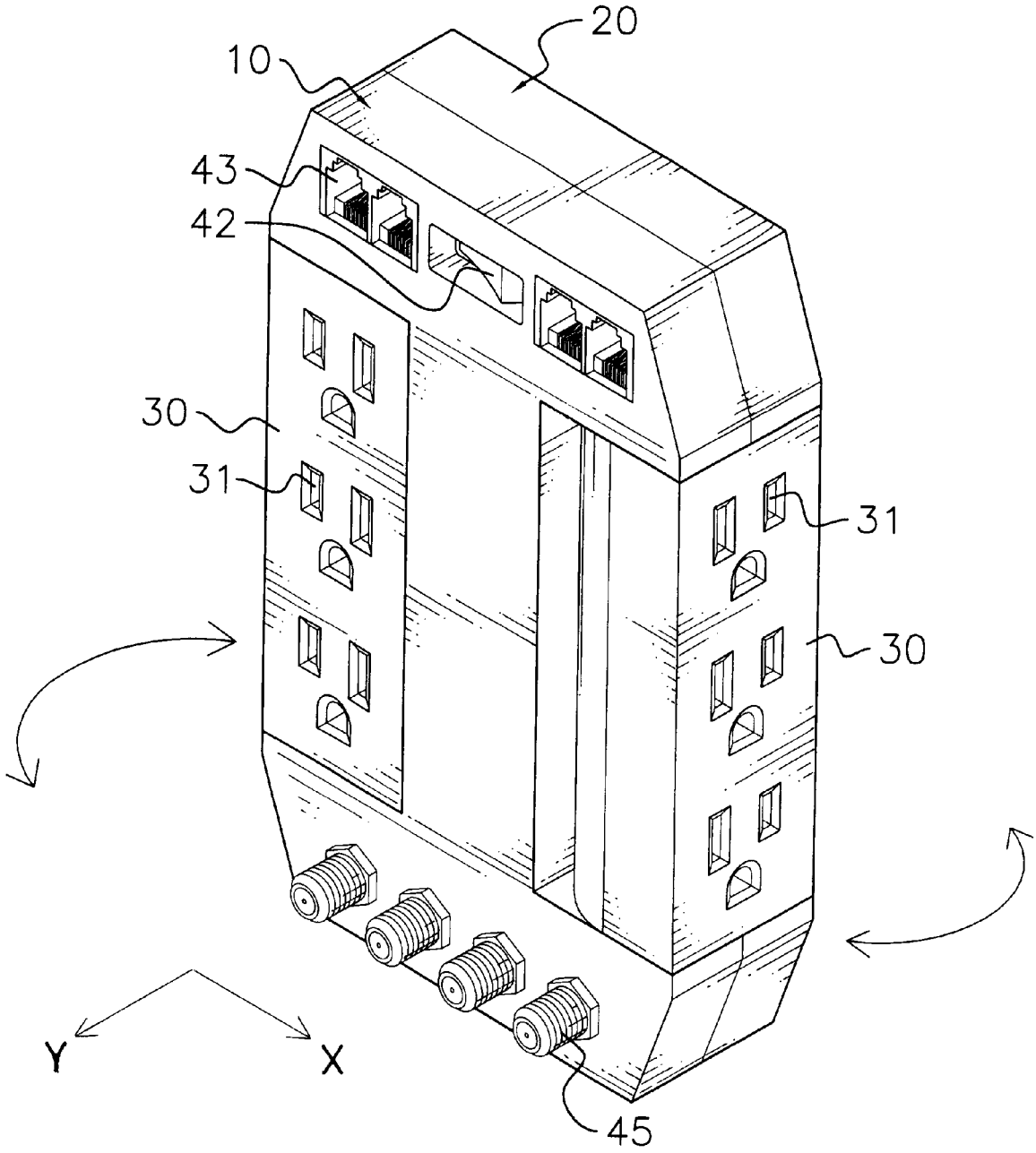
FIG. 2 is a perspective view of a first embodiment of the wall outlet of FIG. 1.

With reference to FIGS. 1 and 2, on a front face (14) of the front chamber (10), multiple rectangular through windows (15) and multiple circular holes (16) are defined to respectively communicate with the upper chamber (12) and the lower chamber (13). Thereby, when the circuit board (40) is retained inside an upper space composed of the upper chambers (12)(22), the telephone wire connectors (43) and the switch (42) received are able to be exposed through the multiple windows (15) for connection with telephone wires (not shown). Moreover, two pairs of coaxial cable connectors (45) are received inside the lower chambers (13)(23) and extend through the circular holes (16).

Figure 3:
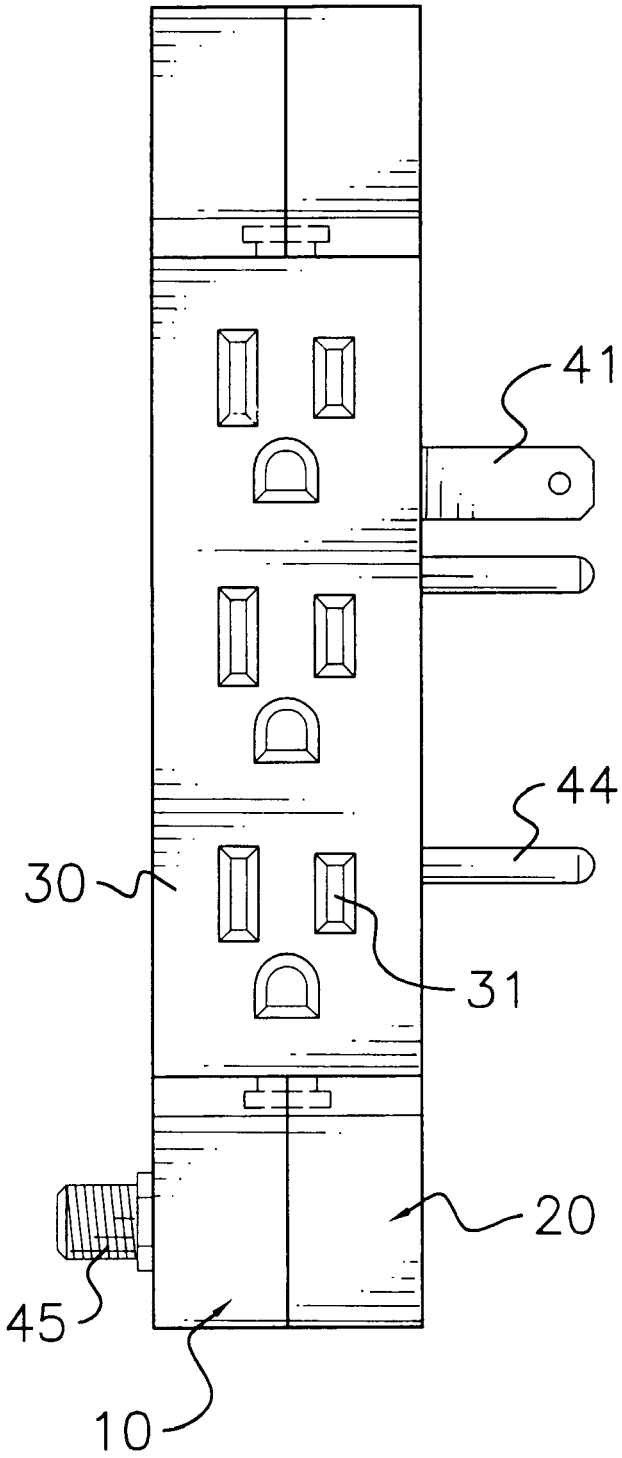
FIG. 3 is a side plan view of the wall outlet assembly of FIG. 1.

With reference to FIGS. 1 and 3, in the center chamber (21) of the rear casing (20), multiple holes (211) are defined to allow the plug (41) to extend therethrough. In this embodiment, a non-conductive stub (44) extending from the circuit board (40) is used as an auxiliary element for insertion into an outlet (not shown) in the wall to make the wall outlet more firmly attachable to the wall, that is to say, only the plug (41) is for electrical connection to the outlet in the wall.

Figure 4:
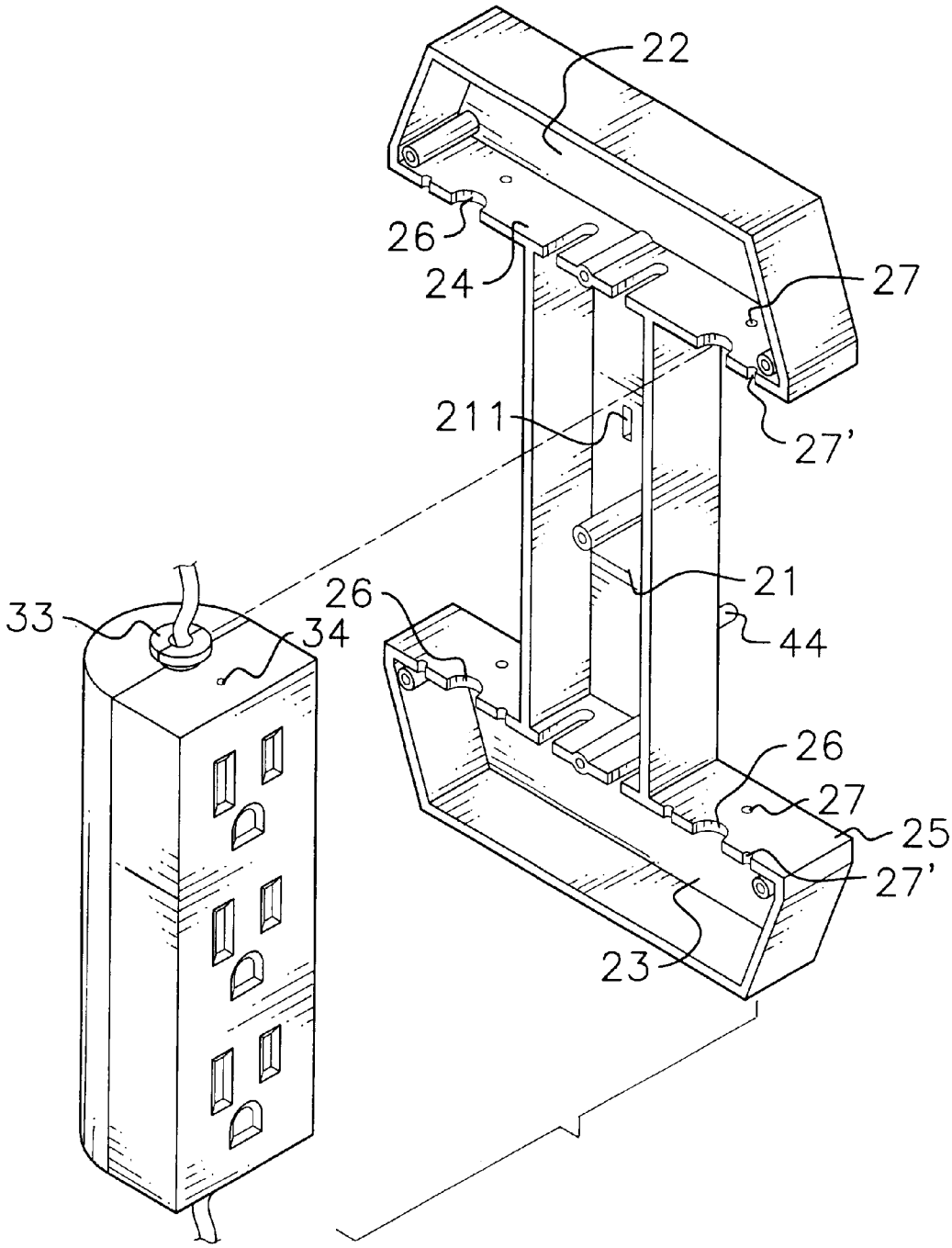
FIG. 4 is an exploded perspective view showing a first embodiment of a base and a casing.
Figure 6:
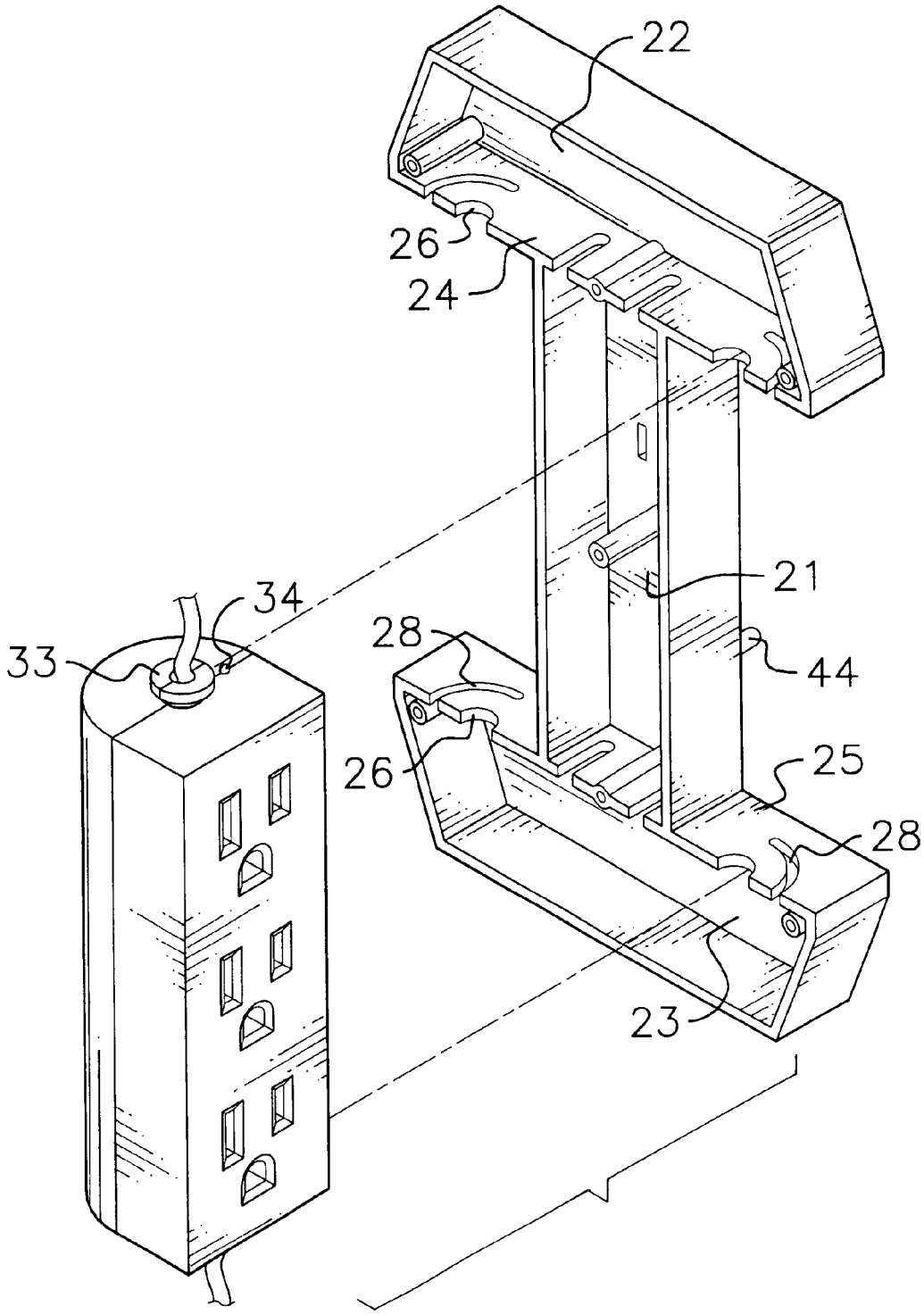
FIG. 6 is an exploded perspective view showing a second embodiment of a base and a casing.

To accomplish the rotatable connection between the base (30) and the housing, the present invention discloses two embodiments as shown in FIGS. 4 and 6, respectively.

Figure 5:
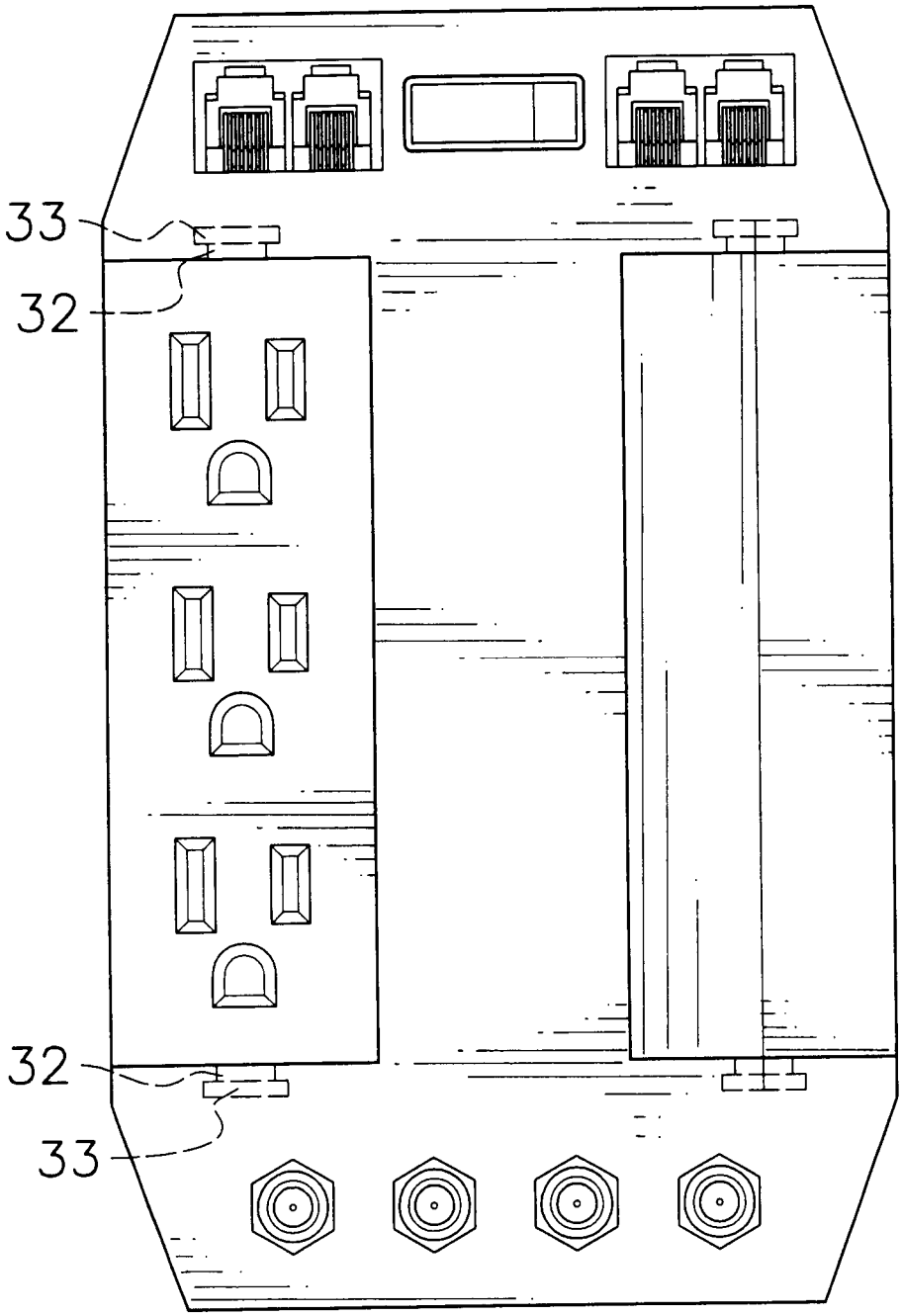
FIG. 5 is a front plan view of the wall outlet assembly of FIG. 1.

With reference to FIGS. 1, 4 and 5, each base (30) has two opposite ends from which an axle (32) formed with a head (33) extends. Further, two protrusions (34) are also respectively formed at the opposite ends of the base (30).

As mentioned foregoing, since the front casing (10) and the rear casing (20) are substantially symmetrical with each other, rotating structures defined in the rear casing (20) are only discussed hereinafter, and the front casing (10) is accordingly omitted. As shown in FIG. 4, the rear chamber

(20) has two opposite partitions (24)(25) that respectively construct the upper chamber (22) and the lower chamber (23). Along a flange of each partition (24)(25), two semicircular cuts (26) are respectively defined and apart from each other. Moreover, several tiny through holes (27) are defined in the two opposite partitions (24)(25) and distributed near each semicircular cut (26) to correspond to the protrusion (34) of the base (30). As shown in FIGS. 1 and 4, a semicircular hole (27') is defined along the flange of each partition (24)(25) and near the semicircular cut (26). Thereby after the front casing (10) and the rear casing (20) are combined together, two semicircular holes (27') of each casing (10)(20) are formed as a circular hole that is just the same as other through holes (27) to correspond to the protrusion (34).

To assemble the two bases (30) in accompany with the front casting (10) and the rear casing (20), two axles (32) at the opposite ends of each base (30) are respectively passed through two circular openings composed of the four corresponding semicircular cuts (26) of the two casings (10)(20). Thereby, two heads (33) on the two axles (32) of each base (30) are respectively retained inside the upper chambers (12)(22) and the lower chambers (13)(23). Thus, the two bases are rotatably connected between the upper chambers (12)(22) and the lower chambers (13)(23).

Moreover, the two protrusions (34) at opposites ends of each base (30) in conjunction with the tiny through holes (27)(27') allow the base to be oriented at a particular position when the protrusions (34) are correspondingly matched with the through holes (27)(27'). For example, as shown in FIG. 2, one base (30) with the surface having sockets (31) is rotated to face a direction X when the two protrusions (34) just correspond to the two holes (27'). The other base (30) is faced toward another direction designated with Y.

With reference to FIG. 6, the through holes (27)(27') as shown in FIG. 4 are replaced by arcuate trenches (28) is this embodiment. These arcuate trenches (28) can be formed as through trenches as shown in the drawing, or as shallow trenches formed at the external surface of the partitions (24)(25) but not through the partitions (24)(25). Thereby the protrusions (34) are able to slide along these trenches (28) when the entire base is rotated.

Figure 7:
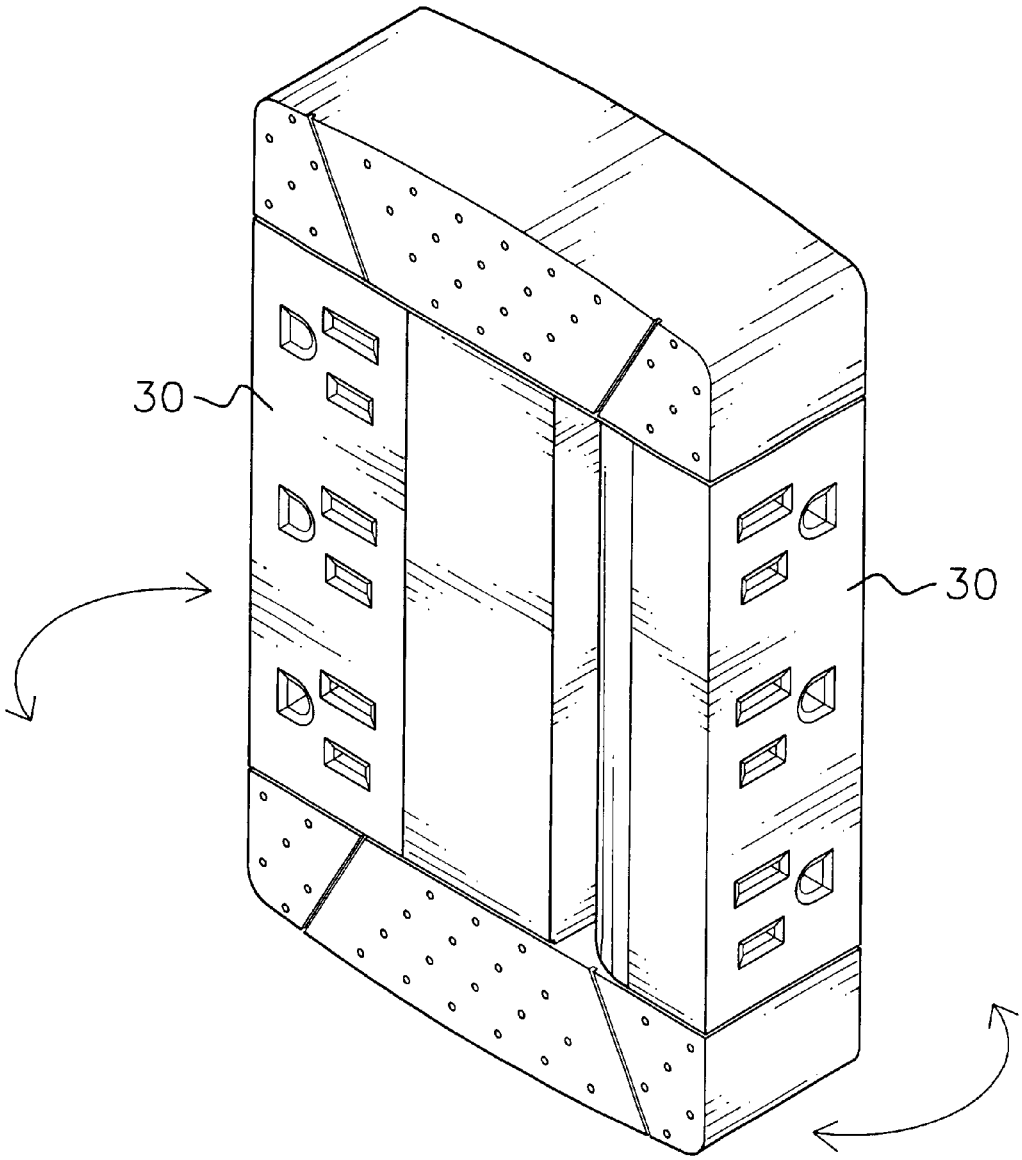
FIG. 7 is a perspective view of a second embodiment of a wall outlet assembly in accordance with the present invention.
Figure 8:
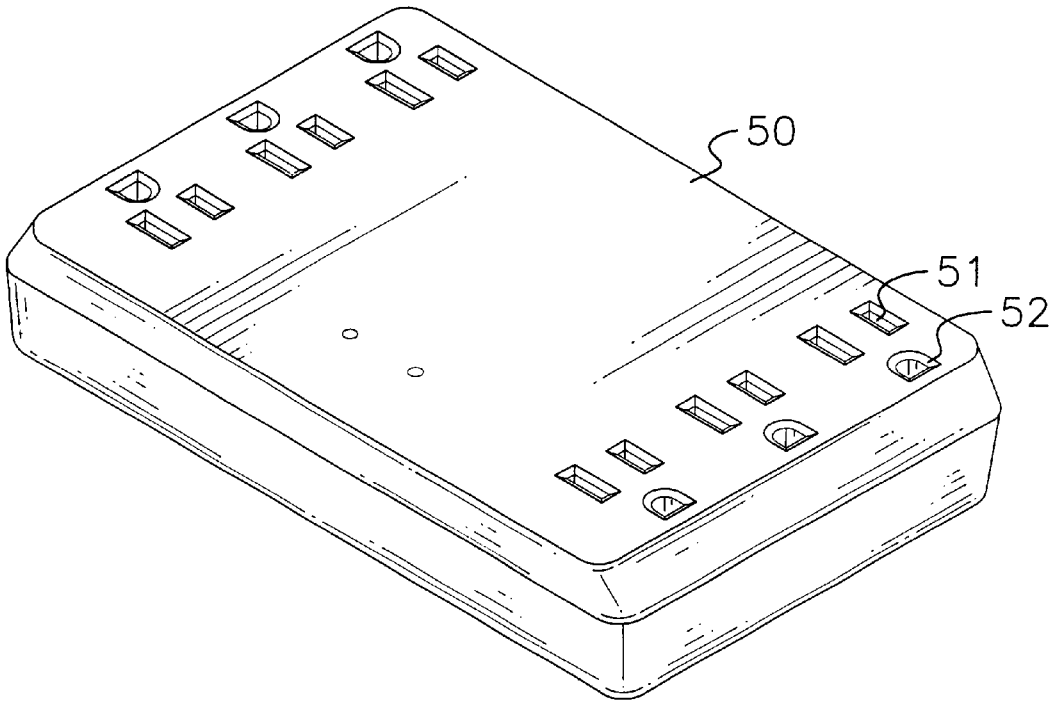
FIG.8 PRIOR ART
FIG. 8 is a perspective view of a conventional wall outlet.

With reference to FIG. 7, a second embodiment of a wall outlet assembly in accordance with the present invention is shown. The wall outlet assembly is substantially the same as that of FIG. 2. The difference is that the telephone wire connectors (43) and the coaxial cable connectors (45) are all omitted. Still, the two bases (30) are rotatably provided between the upper chambers (12)(22) and the lower chambers (13)(23).

The foregoing description of the preferred embodiments of the present invention is intended to be illustrative only and, under no circumstances, should the scope of the present invention be restricted by the description of the specific embodiment.

What is claimed is:

1. A wall outlet assembly comprising:

a housing composed of a front casing and a rear casing symmetrical to the front casing, each of said front casing and rear casing comprising:

a center chamber with opposite sides that respectively communicate with an upper chamber and a lower chamber, said front and rear casings being combined together so as to form two lengthwise spaces at opposite sides of each center chamber and between said upper and lower chambers;

at least one plug extending from the housing; and two bases each of which is rotatably mounted within one of said lengthwise spaces of the housing, each base having at least one socket formed thereon to electrically connect with the plug.

2. The wall outlet assembly as claimed in claim 1, wherein after the front casing and the rear casing are assembled together, an upper space is defined by the two upper chambers of the front casing and the rear casing to receive multiple telephone wire connectors, wherein a front surface of the front casing is defined with multiple through windows to correspond to the multiple telephone wire connectors so each telephone wire connector is exposed.

3. The wall outlet assembly as claimed in claim 1, wherein after the front casing and the rear casing are assembled together, a lower space is defined by the two lower chambers of the front casing and the rear casing to receive multiple coaxial cable connectors, wherein a front surface of the front casing is defined with multiple through holes to correspond to the multiple coaxial connectors so each coaxial cable connector is extending out from the front casing.

4. The wall outlet assembly as claimed in claim 2, wherein after the front casing and the rear casing are assembled together, a lower space is defined by the two lower chambers of the front casing and the rear casing to receive multiple coaxial cable connectors, wherein the front surface of the front casing is further defined with multiple through holes to correspond to the multiple coaxial connectors so each coaxial cable connector is extending out from the front casing.

5. The wall outlet assembly as claimed in claim 1, wherein each base has two opposite ends, and on each end a protrusion and two axles each having a head are formed.

6. The wall outlet assembly as claimed in claim 2, wherein each base has two opposite ends, and on each end a protrusion and two axles each having a head are formed.

7. The wall outlet assembly as claimed in claim 3, wherein each base has two opposite ends, and on each end a protrusion and two axles each having a head are formed.

8. The wall outlet assembly as claimed in claim 4, wherein each base has two opposite ends, and on each end protrusion and two axles each having a head are formed.

9. The wall outlet assembly as claimed in claim 5, wherein both the front chamber and the rear chamber have two opposite partitions that respectively construct the upper chamber and the lower chamber, wherein along a flange of each partition, two semicircular cuts are defined and apart from each other.

10. The wall outlet assembly as claimed in claim 6, wherein both the front chamber and the rear chamber have two opposite partitions that respectively construct the upper chamber and the lower chamber, wherein along a flange of each partition, two semicircular cuts are defined and apart from each other.

11. The wall outlet assembly as claimed in claim 7, wherein both the front chamber and the rear chamber have two opposite partitions that respectively construct the upper chamber and the lower chamber, wherein along a flange of each partition, two semicircular cuts are defined and apart from each other.

12. The wall outlet assembly as claimed in claim 8, wherein both the front chamber and the rear chamber have two opposite partitions that respectively construct the upper chamber and the lower chamber, wherein along a flange of each partition, two semicircular cuts are defined and apart from each other.

13. The wall outlet assembly as claimed in claim 9, wherein each partition is defined with a plurality of through holes to correspond the protrusions.

14. The wall outlet assembly as claimed in claim 10, wherein each partition is defined with a plurality of through holes to correspond the protrusions.

15. The wall outlet assembly as claimed in claim 11, wherein each partition is defined with a plurality of through holes to correspond the protrusions.

16. The wall outlet assembly as claimed in claim 12, wherein each partition is defined with a plurality of through holes to correspond the protrusions.

17. The wall outlet assembly as claimed in claim 9, wherein each partition is defined with an arcuate trench to correspond the protrusions.

18. The wall outlet assembly as claimed in claim 10, wherein each partition is defined with an arcuate trench to correspond the protrusions.

19. The wall outlet assembly as claimed in claim 11, wherein each partition is defined with an arcuate trench to correspond the protrusions.

* * * * *